US011033161B2

(12) United States Patent
Wang et al.

(10) Patent No.: US 11,033,161 B2
(45) Date of Patent: Jun. 15, 2021

(54) ERGONOMIC TOILET EQUIPMENT

(71) Applicant: Xiamen Brana Design Co., Ltd., Fujian (CN)

(72) Inventors: Zhongtang Wang, Fujian (CN); Fulin Yu, Fujian (CN)

(73) Assignee: XIAMEN BRANA DESIGN CO., LTD., Fujian (CN)

( * ) Notice: Subject to any disclaimer, the term of this patent is extended or adjusted under 35 U.S.C. 154(b) by 34 days.

(21) Appl. No.: 16/673,913

(22) Filed: Nov. 4, 2019

(65) Prior Publication Data

US 2020/0187733 A1 Jun. 18, 2020

(30) Foreign Application Priority Data

Dec. 18, 2018 (CN) ..... 201811632093.4

(51) Int. Cl.
*A47K 17/02* (2006.01)
*A47K 13/24* (2006.01)
*E03D 5/10* (2006.01)

(52) U.S. Cl.
CPC ..... *A47K 17/028* (2013.01); *A47K 13/24* (2013.01); *E03D 5/10* (2013.01)

(58) Field of Classification Search
CPC ..... A47K 17/028; A47K 13/24; E03D 5/10
USPC ..... 4/254
See application file for complete search history.

(56) References Cited

U.S. PATENT DOCUMENTS 6,631,524 B1 * 10/2003 Dixon ..... A47C 16/025 297/423.45
2013/0067649 A1 * 3/2013 Rane ..... E03D 11/00 4/254
2014/0130244 A1 * 5/2014 Schottenstein ..... A47K 13/005 4/234
2019/0186115 A1 * 6/2019 Schwab ..... E03D 9/08
2020/0359860 A1 * 11/2020 Loutos ..... A47K 17/028
2021/0015317 A1 * 1/2021 Loutos, II ..... E03D 5/10

* cited by examiner

*Primary Examiner* — Huyen D Le
(74) *Attorney, Agent, or Firm* — Raymond Y. Chan; David and Raymond Patent Firm

(57) ABSTRACT

An ergonomic toilet equipment includes a backrest, a pedal and a balloon pillow. The backrest is disposed on the inner side of the toilet cover, with air bags inflation or suction according to the physiological bending of the user back, providing a healthy and comfortable support. The pedal raises the lower limb according to the user demand, and realizes the physiological structure of bowel movement. The balloon pillow assists the user in creating extra compression in the abdomen to promote bowel movements.

19 Claims, 6 Drawing Sheets

ERGONOMIC TOILET EQUIPMENT

CROSS-REFERENCE TO RELATED APPLICATIONS

The present application claims the benefit of Chinese Patent Application No. 201811632093.4 filed on Dec. 18, 2018. The contents of the above are hereby incorporated by reference.

TECHNICAL FIELD

The invention relates to the field of sanitary ware, in particular to peripheral ergonomic equipment for a seat toilet.

BACKGROUND

The toilet is divided into a squat toilet and a seat toilet. Because the seat toilet is more comfortable and civilized than the squat toilet, it is widely popular in modern society.

When we are squatting, the angle between the upper body and the thigh is 35 degrees, which is the best angle for human body excretion, because the bowel movement is straight down. However, when sitting on the seat toilet, the angle between the upper body and the thigh is 80 to 90 degrees, which would hinder the smoothness of the intestine, leading to constipation and hemorrhoids.

The toilet stool improves the excretion angle when people use the seat toilet by raising the lower limbs, but it is still difficult to achieve the squatting effect. Our analysis believes that the reason lies in:

1. the height of the toilet and the toilet stool is constant, and the height and the leg length of the users are different, so it is difficult to achieve the optimal human excretion angle;
2. compared with the squatting that the body leans forward, the waist and the back are tense for body balance, while sitting on the seat toilet, the waist and back are slack, and the back and abdomen muscles could not participate more to promote bowel movements;
3. when squatting, the thighs are in close contact with the abdomen, furthermore, the abdomen is continuously squeezed to promote defecation, however, when sitting, there is no contact between the thighs and the abdomen, and there is no squeezing effect on the abdomen.

Therefore, there is a need for a peripheral device suitable for the seat toilet, which obtains good support of the lower back when the user defecates, continuously adjusts the height of the lower limbs, and continuously compresses the abdomen, thereby achieving a smooth and convenient bowel movement.

SUMMARY

An ergonomic toilet equipment comprises a backrest device, a pedal device, and an abdominal pressure assisting device, said backrest device comprising a bottom substrate, an airbag array system, and a surface cover cloth, said bottom substrate being disposed on the inner side surface of the toilet cover, said middle layer airbag array system comprising a few air bags, an inflation path, an suction path, a few electromagnetic valves, an inflation pump, a suction pump, a few pressure sensors, a central data processor, a wireless communication module, an intelligent control terminal, and a power.

The pressure sensors are respectively disposed on the left and right surface of the highest point of the arc surface of the air bags, the data collected by the pressure sensors and the user commands instructed by the intelligent control terminal are transmitted to the central data processor through the wireless communication module, to control the switches of the inflation pump and the suction pump according to a specific algorithm, so as to regulate opening and closing of the electromagnetic valves.

The pedal device comprises a feet pedal, a screw lifting system, a control module, a wireless communication module, and a power, said feet pedal comprising a panel, a support frame, and a connect component, said screw lifting system comprising a left screw device and a right screw device.

The user sends an instruction through the intelligent control terminal, the wireless communication module receives the instruction, and controls the screw lifting system through the control module.

The process steps of the equipment comprising: the user sitting on the toilet, issuing instructions through the intelligent control terminal, starting the inflation pump, the air bags inflating, the user holding the abdominal pressure assisting device between the abdomen and the thigh, starting and raising the pedal device, lifting the lower limb to a suitable height, after defecation process, starting the suction pump, emptying the air bags, and the pedal device descending to the floor.

BRIEF DESCRIPTION OF THE DAWINGS

DESCRIPTION OF ASPECTS OF THE DISCLOURE

For a detailed description of the technical contents, structural features, objects and effects of the present invention, the embodiments would be described in detail below with reference to the accompanying drawings.

Figure 1:
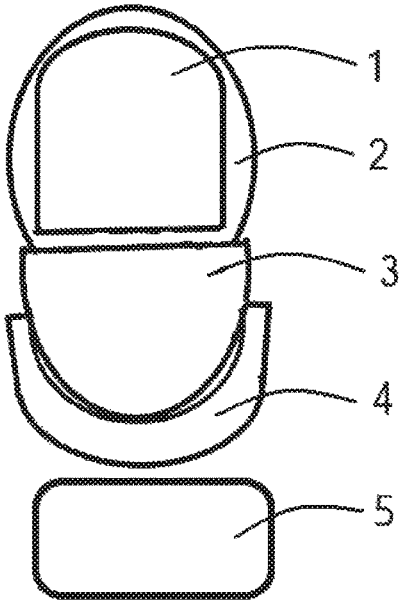
FIG. 1 is a schematic diagram of an ergonomic toilet equipment, comprising a backrest device, a pedal device, and an abdominal pressure assisting device.
Figure 2:
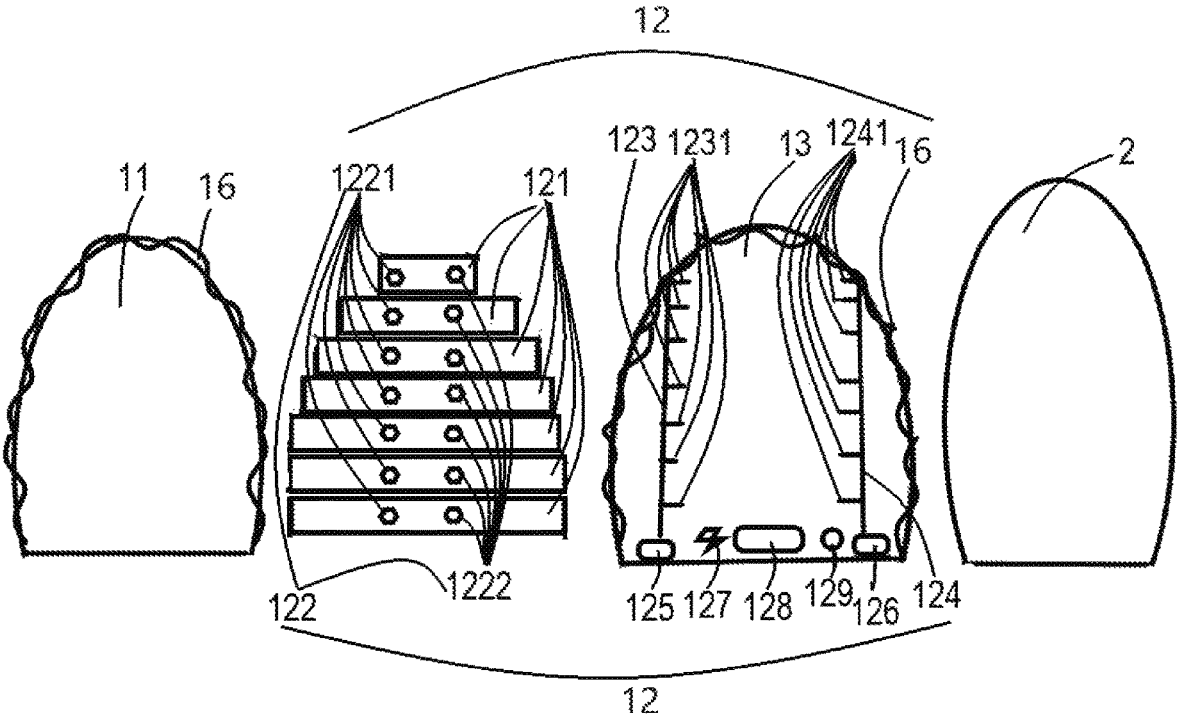
FIG. 2 is a schematic structural view of the backrest device, comprising a cover cloth, an air bags array system, and a bottom substrate.
Figure 3:
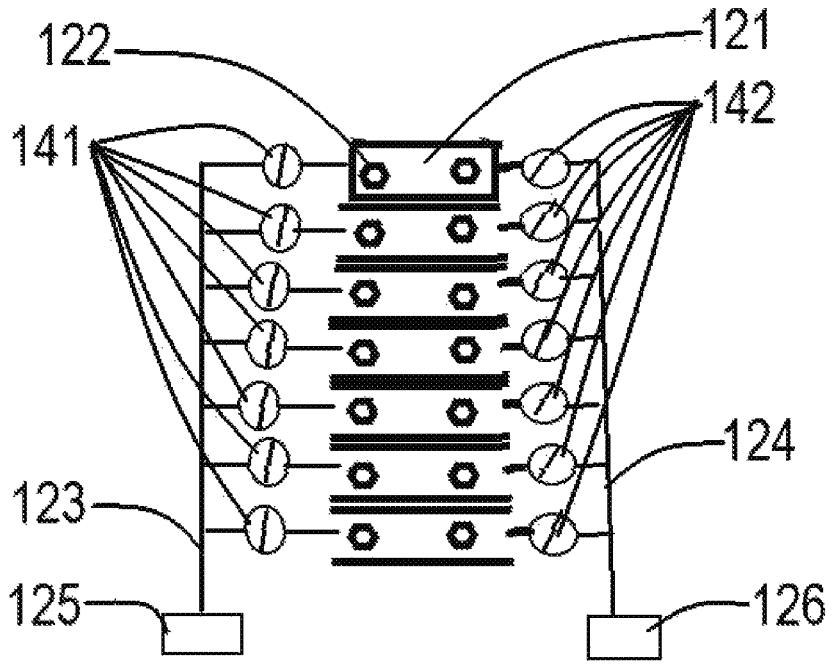
FIG. 3 is a schematic diagram of an airbag array system, comprising a few air bags, an inflation path, a suction path, a few electromagnetic valves, an inflation pump, a suction pump, and a few pressure sensors.
Figure 4:
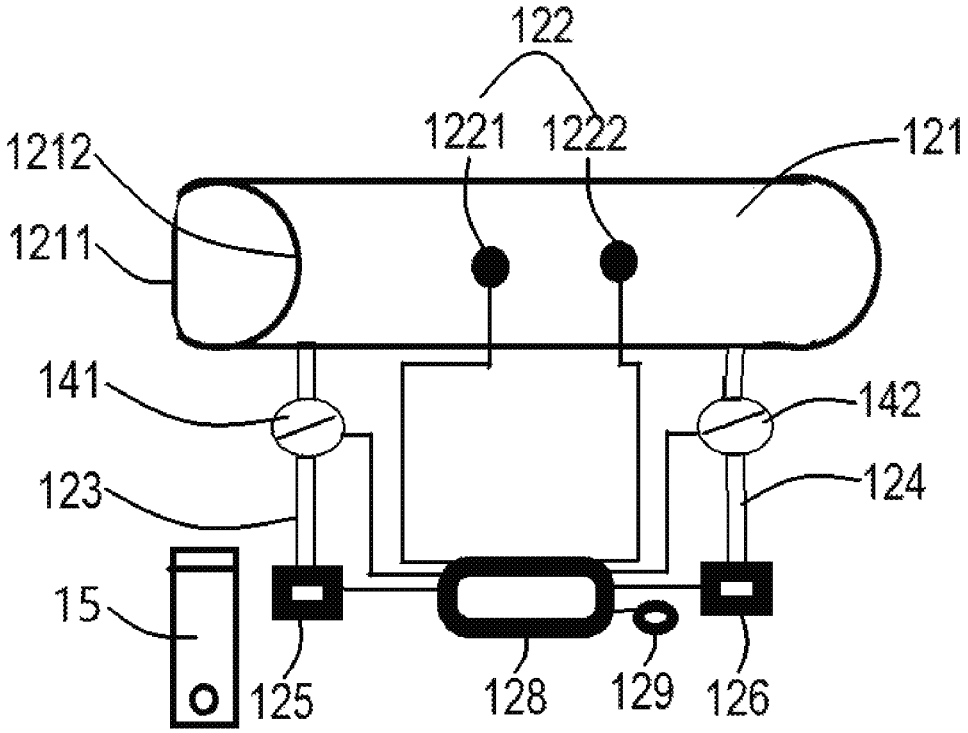
FIG. 4 is a schematic diagram of operation control of the airbag array system, comprising air bag structure, an inflation path, a suction path, electromagnetic valves, an inflation pump, a suction pump, a few pressure sensors, a wireless communication module, and a central data processor.
Figure 5:
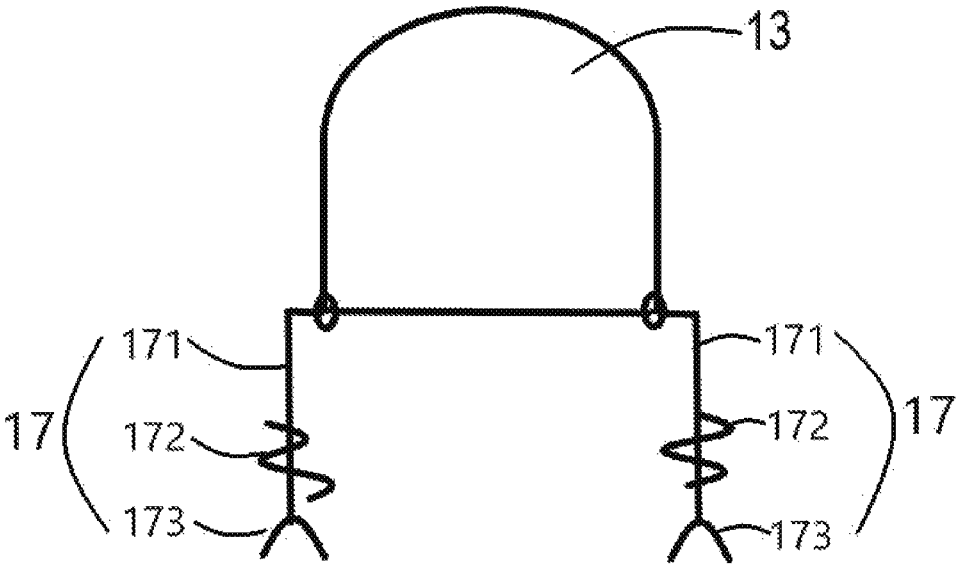
FIG. 5 is a schematic structural view of the bracket provided on the bottom substrate, comprising left and right brackets, columns, height adjustment structures, and support feet.
Figure 6A:
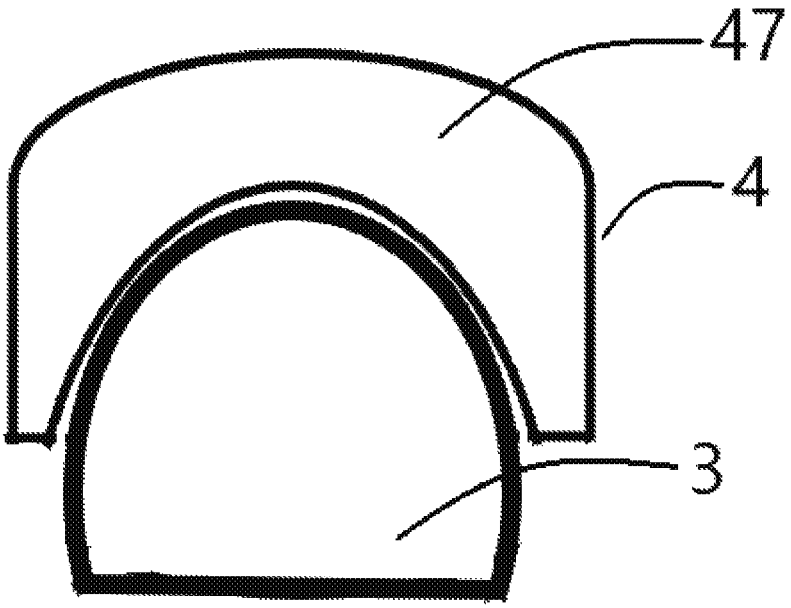
FIG. 6A is a schematic view showing the positional relationship between the pedal device and the toilet.
Figure 6B:
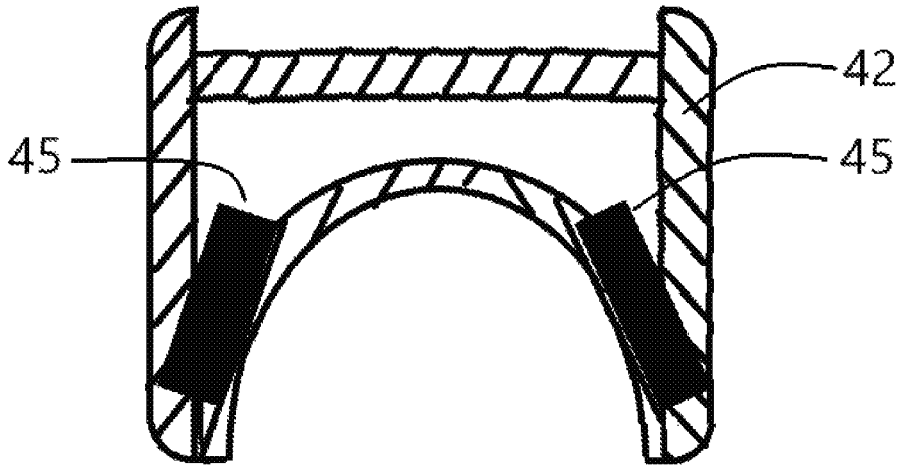
FIG. 6B is a schematic structural view of a support frame and connect component of the pedal device.
Figure 6C:
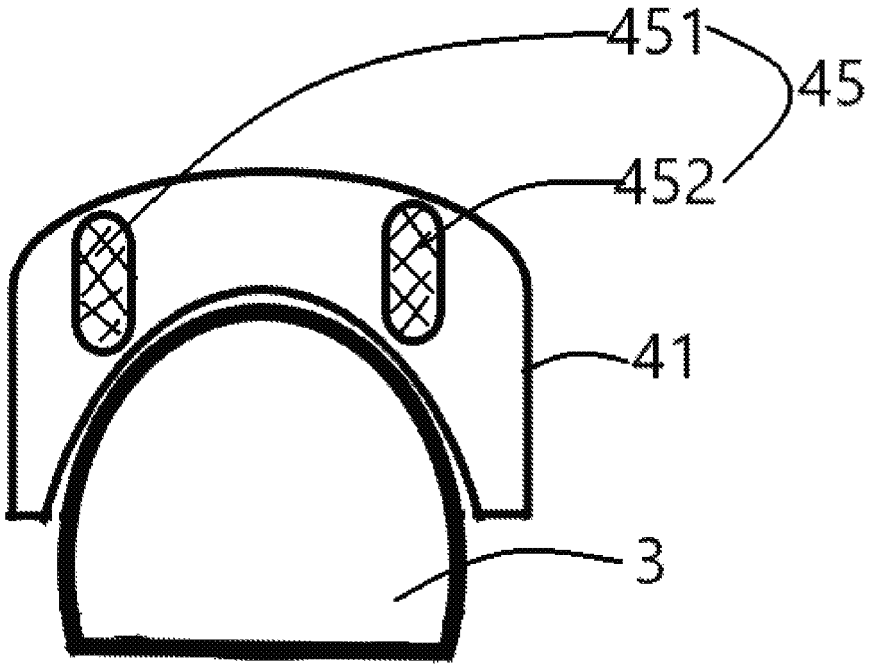
FIG. 6C is a schematic view showing the position of the feet on the pedal device panel when sitting.
Figure 6D:
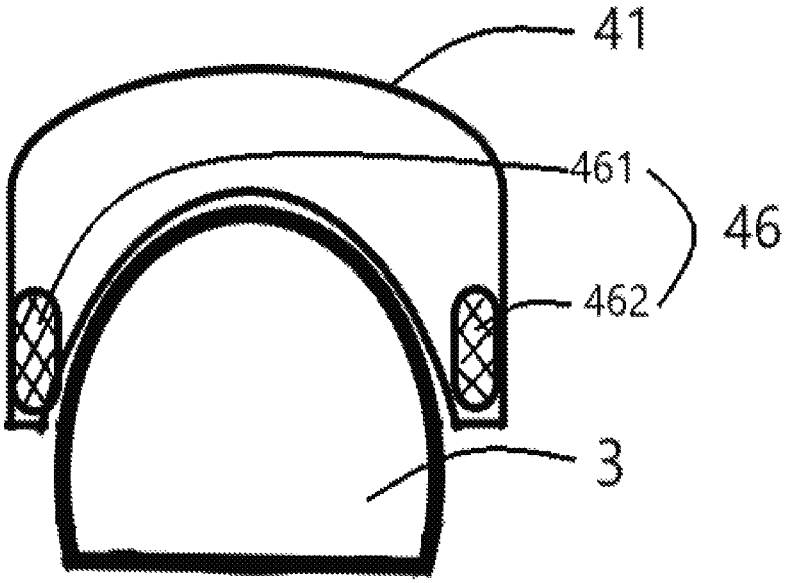
FIG. 6D is a schematic diagram of the position of the feet on the pedal device panel when squatting.
Figure 6E:
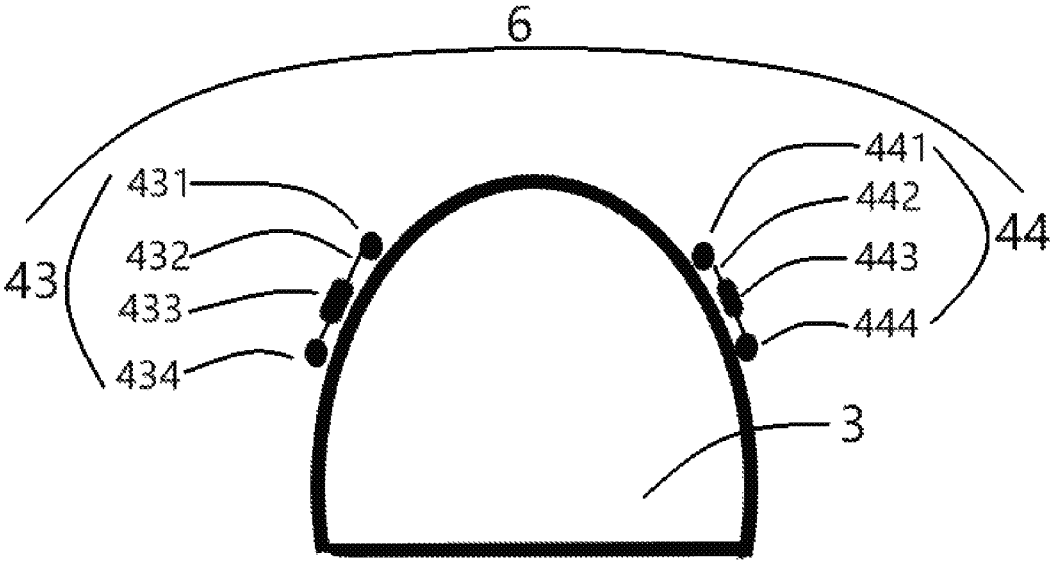
FIG. 6E is a schematic structural view of a screw lifting system, including a left screw device and a right screw device.
Figure 7:
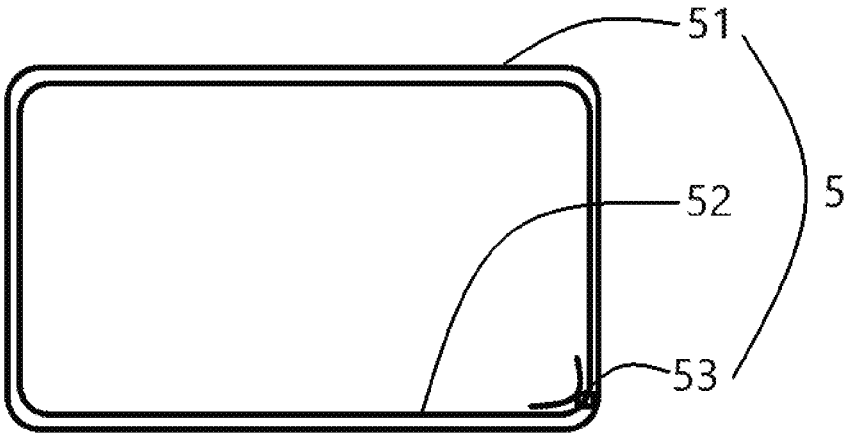
FIG. 7 is a schematic structural view of an abdominal pressure assisting device, comprising a bladder, an outer cover, and a gas valve.

As shown in FIGS. 1 to 7, the present invention discloses the structure, construction, and working principal of an ergonomic toilet equipment.

The ergonomic toilet equipment comprises a backrest device 1, a pedal device 4, and an abdominal pressure assisting device 5.

The backrest device 1 comprises a bottom substrate 13, an airbag array system 12, and a surface cover cloth 11.

The bottom substrate 13 is disposed on the inner side surface of the toilet cover 2 by means of a bond fashion, having a width of 35 to 50 cm, a height of 45 to 60 cm, and a thickness of no more than 2 mm, which is made of hard materials, such as plastic, PVC, ceramic, wood, acrylic, and metal, so as to withstand the pressure of the user lower back.

The airbag array system 12 is disposed on the surface of the bottom substrate 13, comprising a few air bags 121, an inflation path 123, a suction path 124, a few inflation electromagnetic valves 141, a few suction electromagnetic valves 142, an inflation pump 125, an suction pump 126, a few pressure sensors 122, a central data processor 128, a wireless communication module 129, an intelligent control terminal 15, and a power 127.

The inflation path 123 and the suction path 124 are respectively arranged in a longitudinal direction, and are disposed on the front surface of the bottom substrate 13. Furthermore, the inflation path 123 and the suction path 124 are respectively divided into a series of inflation branches 1231 and suction branches 1241, which are horizontally arranged with an interval of 5 cm. The inflation branches 1231 and the suction branches 1241 are respectively connected to the air bags 121 through the inflation electromagnetic valves 141 and the suction electromagnetic valves 142 in a one-to-one manner. The bottom end ports of the inflation path 123 and the suction path 124 are respectively connected to the inflation pump 125 and the suction pump 126. Moreover, the inflation pump 125 and the suction pump 126 are horizontally disposed at the bottom end of the front surface of the bottom substrate 13.

The air bags 121 which having a nearly semi-tubular shape, are disposed on the front surface of the bottom substrate 13, and are arranged tightly in a horizontal direction to form an air bag 121 array. The bottom surface 1211 of the semi-tubular air bag 121 is fixed to the bottom substrate 13, while the arc surface 1212 of the semi-tubular air bag 121 is in a free state. Furthermore, the diameter of the air bag 121 is 5 cm at the middle part, and is gradually increased to 10 cm at the left and right ends of the air bag 121 respectively, so to form a concave structure to accommodate the user lower back.

Furthermore, the air bag 121 is made of rubber material, or polyurethane material. The thickness of the air bag 121 wall is 0.1 to 0.5 mm, the stretchable ratio of the air bag 121 wall is not less than 5 times, the highest point of the front side of the air bag 121 could move forward by not less than 25 cm when the air bag 121 is completely inflated. The thickness of the air bag 121 after folding does not exceed 1 cm in full-empty state.

A left side pressure sensor 1221 and a right side pressure sensor 1222 are respectively disposed on the left side surface and the right side surface of the highest point of the arc surface 1212 of the air bag 121, with a distance of 5 cm away from the middle point of the air bag 121.

The data collected by the left side pressure sensors 1221 and the right side pressure sensors 1222, and command instructed by the user through the intelligent control terminal 15 are transmitted to the central data processor 128 through the wireless communication module 129, to control the switches of the inflation pump 125 and the suction pump 126 according to a specific algorithm, so as to regulate opening and closing of the inflation electromagnetic valves 141 and the suction electromagnetic valves 142.

Furthermore, the pressure sensors 122 are configured to monitor the pressure value between the air bags 121 and the user body, and the pressure difference between the left side and the right side of the user body, to determine whether the air bags 121 provide sufficient effective support for the user lower back or not, and whether the user sitting posture might be correct or not, according to a specific algorithm.

The specific algorithm of the central data processor 128 comprises:

(a) the user sets the range of pressure values between the air bags 121 and the user body, which generally recommended from 80 mmHg to 120 mmHg;

(b) if the pressure values between the air bags 121 and the user body is less than 80 mmHg, then the air bags 121 would be going to inflate, on the other hand, if the pressure values between the air bags 121 and the user body is more than 120 mmHg, then the air bags would be going to suction;

(c) if the pressure value difference between the left and right sides of the air bags 121 and the user body is more than 30 mmHg, it indicates that the user might be sitting incorrectly, then the user would be reminded to adjust the sitting posture;

(d) if the pressure value between the air bags 121 and the user body continues to be less than 80 mmHg, it indicates that the inflation pump 125 might be malfunction, while, if the inflation pump 125 works normally, then the inflation path 123 and/or the air bags 121 might be leakage;

(e) if the pressure value between one of the air bags 121 and the user body continues to be less than 80 mmHg, it indicates that the air bag 121 might be broken, while, if the air bag is in good condition, then it indicates that the path and/or the branch might be leakage;

(f) when the user stops usage, the suction pump 126 works, if the pressure between the air bags 121 and the user body remains more than 120 mmHg, or the pressure values of all the air bags 121 are not lowered, it indicates that the suction pump 126 might faulty;

(g) if the inflation and/or suction function does not work, it indicates that the inflation path 123 or suction path 126 might be damaged; and (h) when re-use, through the biometric or intelligent terminal control 15, the central data processor 128 calls up the user past data, constructs a toilet back shape suitable for the user, the pedal device 4 raises to a suitable height, when the sitting posture changing, the toilet back shape and the pedal device 4 height could fine-tune accordingly.

The surface cover cloth 11, which is made of textile, or leather, or silicone rubber, is connected to the bottom substrate 13 in a zipper 16, or a button, or a pull button, or a magnet piece, or a tie fashion, and could be detached, replaced, and cleaned.

Of course, the bottom substrate 13 could also be formed into an outer shape of a toilet cover 2 to realize the function of the toilet cover 2, thereby replacing the traditional toilet cover 2, simplifying the toilet structure.

The bottom substrate 13 is provided with a bracket 17, and the bottom end 173 of the column 171 on the left and right sides of the bracket 17 respectively is connected with the floor to provide strong support, so as to prevent the damage of the toilet cover 2 caused from user excessive pressure. Furthermore, a height adjustment structure 172 is disposed in the middle section of the left side column 171 and the right side column 171, respectively.

For the purpose of safety and comfort, there are a pair of handrails on both sides of the bracket 17, which could be rotated and stored.

The pedal device 4 comprises a foot pedal 47, a screw lifting system 6, a control module, a wireless communication module, and a power.

The foot pedal 47 comprising a panel 41, a support frame 42, and a connect component 45, is disposed on the left front side, the front side, and the right front side of the toilet 3 body.

The screw lifting system 6 comprises a left screw device 43 and a right screw device 44, which is respectively disposed on the left side of the toilet 3 and the right side of the toilet 3. The left screw device 43 comprises a left front lead screw 431, a left rear lead screw 434, two reversing gear boxes, a transmission shaft 432, and a speed reducer 433. The right screw device 44 comprises a right front lead screw 441, a right rear lead screw 444, two reversing gear boxes, a transmission shaft 442, and a speed reducer 443.

The left front lead screw 431 and the left rear lead screw 434 of the left screw device 43 are axially erected, and the lower end thereof is connected to the reversing gear box output gear. The left and right ends of the transmission shaft 432 are connected to the input gear of the reversing gear box, and the output gear of the speed reducer 433 is coaxially connected with the transmission shaft 432. A lift frame is disposed between the left front lead screw 431 and the left rear lead screw 434, which is fixedly connected to the support frame 42 of the foot pedal 47 through the connect component 45.

The right front lead screw 441 and the right rear lead screw 444 of the right screw device 44 are axially erected, and the lower end thereof is connected to the reversing gear box output gear. The left and right ends of the transmission shaft 442 are connected to the input gear of the reversing gear box, and the output gear of the speed reducer 443 is coaxially connected with the transmission shaft 442. A lift frame is disposed between the right front lead screw 441 and the right rear lead screw 444, which is fixedly connected to the support frame 42 of the foot pedal 47 through the connect component 45.

Then, the user issues an instruction through the intelligent control terminal 15, and the wireless communication module receives the instruction to adjust the screw lifting system 6 by means of the control module.

The bracket 17 of the bottom substrate 13 is coupled to the bottom ends of the left screw device 43 and the right screw device 44 of the pedal device 4 through a connecting rod to increase the stability of the equipment. Moreover, a detachable structure is provided at both ends of the connecting rod.

The abdominal pressure assisting device 5 with a shape of a pillow-like, having a length of 35 to 50 cm, a width of 25 to 30 cm, and a thickness of 5 to 15 cm, comprises an inner bladder 52, an outer cover 51 and a gas valve 53. Wherein the inner bladder 52 is a pneumatic tire structure, with a wall thickness of 0.1 to 0.5 mm, a pressure range of 90 to 120 mmHg. Wherein the outer cover 51 is made of elastic textile, or liquid silicone. The gas valve 53 is configured as a one-way valve for the inner bladder 52 inflation and suction.

The category of intelligent control terminal 15 might include a wired intelligent controller, a wireless intelligent controller, a mobile intelligent terminal, and others. The choice of control the equipment manner might include a line control, a remote control, a voice control, and others.

The process steps of the equipment including:

1. the user sitting on the toilet, issuing instructions through the intelligent control terminal 15, starting the inflation pump 125;

2. the electromagnetic valve 141 of the inflation path 123 opening, the air bags 121 inflating, the air bags 121 moving forward, and touching the user lower back;

3. the pressure sensors 122 on the surface of the air bags 121 collecting data, and transmitting the data to the central data processor 128, when the pressure value of the air bags 121 reaching the pre-set pressure value, the central data processor 128 issuing a command that the electromagnetic valve 141 closes, and the inflation pump 125 stops working;

4. the user holding the abdominal pressure assisting device 5 between the abdomen and the thigh;

5. the user issuing an instruction through the intelligent control terminal 15, starting and raising the pedal device 4, lifting the lower limb to a suitable height;

6. during the user defecation process, when the sitting posture changing, the pressure sensors 122 on the surface of the air bags 121 detecting the change, and the data of the change transmitting to the central data processor 128, 6-1. when the pressure value of the air bag 121 lower than the pre-set pressure value, the inflation pump 125 starting, the electromagnetic valve 141 of the inflation path opening, the air bag 121 inflating, 6-2. when the pressure value of the air bag 121 higher than the pre-set pressure value, the suction pump 126 starting, the electromagnetic valve 142 of the suction path opening, the air bag 121 suctioning, and 6-3. when the user gives an instruction confirmation through the intelligent control terminal 15, the air bags 121 stopping inflation, or suction, thereby providing a healthy and comfortable support for the user lower back;

7. after defecation process, the user sending a command through the intelligent terminal 15, the central data processor 128 receiving the command, storing the user data of the air bag 121 pressure value, opening the electromagnetic valve 142, starting the suction pump 126, emptying the air bags 121, storage the air bags 121, and the pedal device 4 descending to the floor; and 8. when re-use, through the biometric or intelligent terminal control 15, the central data processor 128 calling up the user past data, constructing a toilet back shape suitable for the user, 8-1. when sitting on the toilet, the pedal device 4 raising to a suitable height, and 8-2. when the sitting posture changing, the toilet back shape and the pedal device 4 height fine-tuning necessarily.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An ergonomic toilet equipment comprises a backrest device, a pedal device, and an abdominal pressure assisting device, the backrest device comprising a bottom substrate, an airbag array system, and a surface cover cloth, the pedal device comprising a foot pedal, a screw lifting system, a control module, a wireless communication module, and a power, the abdominal pressure assisting device with a shape of a pillow, a length of 35 to 50 cm, a width of 25 to 30 cm, and a thickness of 5 to 15 cm, comprising an inner bladder, an outer cover and a gas valve, said inner bladder having a pneumatic tire structure, with a wall thickness of 0.1 to 0.5 mm, a pressure of 90 to 120 mmHg.

2. The equipment according to claim 1, wherein said bottom substrate is disposed on the inner side surface of the toilet cover, having a width of 35 to 50 cm, a height of 45 to 60 cm, and a thickness of no more than 2 mm, which is made of hard plastic, so as to withstand the pressure of the user lower back.

3. The equipment according to claim 1, wherein said airbag array system comprises a few air bags, an inflation path, a suction path, a few electromagnetic valves, an inflation pump, a suction pump, a few pressure sensors, a central data processor, a wireless communication module, an intelligent control terminal, and a power.

4. The equipment according to claim 3, wherein said inflation path and said suction path are respectively arranged in a longitudinal direction, and are disposed on a front surface of the bottom substrate, with a few branches disposed at interval of 5 cm, and the bottom end ports thereof are respectively connected to the inflation pump and the suction pump, furthermore, the inflation pump and the suction pump are horizontally disposed at bottom end of the front surface of the bottom substrate, the branches are respectively connected to the air bags through the electromagnetic valves in an one-to-one manner.

5. The equipment according to claim 3, wherein said air bags having an approximately semi-tubular shape, with the thickness of the bag wall 0.1 to 0.5 mm, with the stretchable ratio of the bag wall not less than 5 times, and with the highest point of the front side of the air bag forwarded by not less than 25 cm when the air bag completely inflated, are disposed on the front surface of the bottom substrate, and are arranged tightly in a horizontal direction to form an air bag array, furthermore, the diameter of the air bag is 5 cm at the middle part, and is gradually increased to 10 cm at the left and right ends respectively, so to form a concave structure to enfold the user lower back.

6. The equipment according to claim 3, wherein said pressure sensors are respectively disposed on the left and right surface of the highest point of the arc surface of the air bag, the pressure sensor collecting data and the user instructing command through the intelligent control terminal are transmitted to the central data processor through the wireless communication module, to control the switches of the inflation pump and the suction pump according to a specific algorithm, so as to regulate opening and closing of the electromagnetic valves.

7. The equipment according to claim 3, wherein said pressure sensors are configured to detect pressure value between the air bags and the user body and pressure difference between the left sides and the right sides of the user body, so as to evaluate the support effect of the user lower back and the verticality degree of user sitting posture.

8. The equipment according to claim 3, wherein said central data processor controls and monitors the function of the air bags, the paths, the electromagnetic valves, and the pumps through specific algorithms, said specific algorithms comprising:

(a) the user setting the range of pressure value between the air bags and the user body, which generally recommended from 80 mmHg to 120 mmHg;

(b) if the pressure value between the air bags and the user body lower than 80 mmHg, then the air bags inflating, (c) on the other hand, if the pressure value between the air bags and the user body higher than 120 mmHg, then the air bags suctioning;

(d) when the pressure difference between the left and right sides of the air bags and the user body more than 30 mmHg, the user being prompted in an oblique posture;

(e) when the pressure value between one of the air bags and the user body continuous lower than 80 mmHg, it indicating that the air bag might be broken, or the branches may be leakage; and (f) when the pressure value between one of the air bags and the user body continuous higher than 120 mmHg, it indicating that the suction pump might be malfunction.

9. The equipment according to claim 1, wherein said surface cover cloth, which is made of textile, is connected to the bottom substrate in a zipper manner, and could be detached, replaced, and cleaned.

10. The equipment according to claim 1, wherein said foot pedal comprising a panel, a support frame, and a connect component, is disposed on the left front side, the front side, and the right front side of the toilet.

11. The equipment according to claim 10, wherein said support frame is disposed between the two erect screws of the screw device, and connected to the lift frame through the connect component.

12. The equipment according to claim 1, wherein said screw lifting system comprises a left screw device and a right screw device, the screw device each comprising two screw rods, two variable gear boxes, a transmission shaft and a gear motor.

13. The equipment according to claim 12, wherein said left screw device is disposed on the left side of the toilet, and said right screw device is disposed on the right side of the toilet.

14. The equipment according to claim 1, wherein said bottom substrate could also be formed into a shape of a toilet cover, which may replace the traditional toilet cover.

15. The equipment according to claim 1, wherein said bottom substrate is provided with a bracket, and the bottom end of the column on the left and right sides of the bracket is connected with the floor to furnish strong support.

16. The equipment according to claim 15, wherein said bracket is coupled to the bottom end of the screw device of the pedal device through a connecting rod to increase the stability of the equipment.

17. The equipment according to claim 15, wherein said the bracket also comprises a pair of handrails on both sides, which could be rotated storage, providing the user with safety and comfort.

18. The equipment according to claim 1, wherein said intelligent control terminal includes a wired intelligent controller, a wireless intelligent controller and a mobile intelligent terminal, moreover, the control manner of the equipment includes a line control, a remote control, and a voice control.

19. A process steps of the equipment comprising:

(a) the user sitting on the toilet, issuing instructions through the intelligent control terminal, starting the inflation pump;

(b) the electromagnetic valves opening, the air bags inflating, the air bags moving forward, and touching the user lower back, (c) the pressure sensors collecting data, and transmitting the data to the central data processor, when the pressure value reaching the pre-set pressure value, the central data processor issuing a command that the electromagnetic valves are closed, and the inflation pump stops working;

(d) the user holding the abdominal pressure assisting device between the abdomen and the thigh, (e) issuing an instruction through the intelligent control terminal, starting and raising the pedal device, raising the lower limb to a suitable height;

(f) during the user defecation process, when the sitting posture changing, the volume of the air bags changing accordingly, thereby providing a healthy and comfortable support for the user lower back;

(g) after the end of bowel movements, the user sending a command through the intelligent terminal, the central data processor receiving the command, storing the user data, opening the electromagnetic valves, starting the suction pump, emptying the air bags, and the pedal device descending to the floor; and (h) when re-using, through the biometric or intelligent terminal control, the central data processor calling up the user past data, and constructing a back shape suitable for the user, when sitting on the toilet, the pedal device raising to a suitable height, and fine-tuning if necessary.

* * * * *